US008010035B2

(12) United States Patent
Furushige

(10) Patent No.: US 8,010,035 B2
(45) Date of Patent: Aug. 30, 2011

(54) IMAGE FORMING APPARATUS

(75) Inventor: Katsuji Furushige, Osaka (JP)

(73) Assignee: Kyocera Mita Corporation (JP)

( * ) Notice: Subject to any disclaimer, the term of this patent is extended or adjusted under 35 U.S.C. 154(b) by 1009 days.

(21) Appl. No.: 11/903,725

(22) Filed: Sep. 24, 2007

(65) Prior Publication Data

US 2008/0075487 A1 Mar. 27, 2008

(30) Foreign Application Priority Data

Sep. 25, 2006 (JP) ..... 2006-259481

(51) Int. Cl.
*G03G 15/00* (2006.01)

(52) U.S. Cl. ..... 399/393; 399/23; 399/43; 399/66; 399/68; 399/76; 399/299; 399/301; 399/388; 399/394

(58) Field of Classification Search ..... 399/23, 399/43, 66, 68, 76, 299, 301, 388, 393, 394
See application file for complete search history.

(56) References Cited

FOREIGN PATENT DOCUMENTS

| | | | |
|---|---|---|---|
| JP | 60004957 A | * | 1/1985 |
| JP | 2002-323839 | | 11/2002 |
| JP | 2004-13039 | | 1/2004 |

* cited by examiner

*Primary Examiner* — Daniel J Colilla
*Assistant Examiner* — Andy L Pham
(74) *Attorney, Agent, or Firm* — Gerald E. Hespos; Michael J. Porco

(57) ABSTRACT

An image forming apparatus includes a sheet-feeder for feeding a recording sheet from a sheet cassette. Image forming devices are provided for forming a toner image. An image bearer bears a toner image formed by the image forming devices; and a transferring device transfers the toner image on the image bearer to a recording sheet. A sheet amount detector detects the amount of recording sheets in the cassette. A mode controller allows the image forming devices to start their operations before the sheet feeding section conveys a recording sheet when the amount of recording sheets detected by the sheet amount detector exceeds a predetermined reference amount, and allows the image forming devices to start their operations after the sheet-feeding section conveys the recording sheet when the amount of recording sheets detected by the sheet amount detector is smaller than the reference amount.

12 Claims, 4 Drawing Sheets

IMAGE FORMING APPARATUS

BACKGROUND OF THE INVENTION

1. Field of the Invention

The present invention relates to an image forming apparatus, more particularly, it relates to an image forming processing.

2. Description of the Related Art

Conventionally, in an image forming apparatus provided with toner image forming units for respective colors arranged along an image bearing member for color printing, a distance and a time length from starting of image formation performed by each toner image forming unit to completion of transferring a formed toner image to a recording sheet becomes long. Therefore, in aim of shortening a printing time, a control is executed to start forming a toner image at a timing earlier than a start timing of feeding a recording sheet from a sheet feeding cassette. In an image forming apparatus where such control is executed, when a toner image arrives earlier than a recording sheet at a position where the toner image is transferred to the recording sheet, the toner image is disposed of, and then another toner image is formed and transferred to the recording sheet. Accordingly, toner particles are wasted when an arrival of a recording sheet to the toner image transferring position delays. In view of this, in an image forming apparatus disclosed in Japanese Patent Unexamined Publication No. 2004-13039, a delay in conveyance of a recording sheet is detected precociously. Then, an image formation performed by an image forming section is suspended immediately when the delay in conveyance is detected, and an arrival of the recording sheet is waited. Accordingly, disposal of an untransferred toner image is prevented from generating so that waste of toner particles is eliminated.

However, in the case of the image forming apparatus disclosed in the above-described patent document, when the recording sheets stored in the sheet cassette runs out, it would be necessary to dispose of the toner image formed before the feeding of sheets from the sheet cassette or suspend the image forming operation performed by the image forming section. Therefore, there would be a likelihood that toner particles are wasted, and it requires a long period of time to restart the image forming operation and complete the transfer of the toner image to the recording sheet.

SUMMARY OF THE INVENTION

An object of the present invention is to provide an image forming apparatus which reduces the amount of disposed toner particles and shortens the printing time.

An image forming apparatus according to the present invention comprises: a sheet-feeding section for taking out and feeding a recording sheet stored in a sheet cassette; an image forming section including: image forming devices provided for respective colors for forming a monochromatic or color toner image; an image bearing member for bearing a toner image formed by the image forming devices; and a transferring device for transferring the toner image formed on the image bearing member to a recording sheet conveyed by the sheet-feeding section; a sheet amount detector for detecting the amount of recording sheets stored in the sheet cassette; an instruction reception section for receiving an image forming instruction to form a toner image on a recording sheet; and a mode controller for executing an image formation preceding mode operation of allowing the image forming devices to start their respective image forming operations before the sheet feeding section conveys a recording sheet from the sheet cassette when the instruction reception section receives the image forming instruction and the amount of recording sheet detected by the sheet amount detector is greater than a predetermined reference amount, and executing a sheet conveyance preceding mode operation of allowing the image forming devices to start their respective image forming operations after the sheet-feeding section conveys the recording sheet from the sheet cassette when the instruction reception section receives the image forming instruction and the amount of recording sheets detected by the sheet amount detector is smaller than the reference amount.

According to this configuration, when the amount of recording sheets detected by the sheet amount detector is greater than a predetermined reference amount, an image formation preceding mode operation of allowing the image forming devices to start their respective image forming operations before the sheet feeding section conveys a recording sheet from the sheet cassette is executed. Accordingly, the printing time becomes short. In this case, even if the recording sheets stored in the sheet cassette are consumed, the recording sheets onto which a toner image formed on the image bearing member with an image forming operation started in the image formation preceding mode is transferred do not run out. Thus, disposal of toner particles due to lack of recording sheets onto which the toner image is transferred do not occur. Consequently, the amount of disposed toner particles can be reduced. On the other hand, when the amount of recording sheets detected by the sheet amount detector is less than the reference amount, in other words, when the image forming operation is started in the image formation preceding mode before the recording sheet is conveyed, and there is a likelihood that the recording sheets stored in the sheet cassette are consumed, and the recording sheets onto which the toner image formed on the image bearing member by the image forming operation run out, the sheet conveyance preceding mode operation of allowing the image forming devices to start the respective image forming operations after the sheet-feeding section conveys the recording sheets from the sheet cassette. Accordingly, disposal of toner particles due to non-existence of recording sheets onto which the toner image is transferred would not occur. Consequently, the amount of disposed toner particles can be reduced.

These and other objects, features and advantages of the present invention will become more apparent upon reading of the following detailed description along with the accompanied drawings.

DETAILED DESCRIPTION OF THE PREFERRED EMBODIMENTS

Figure 1:
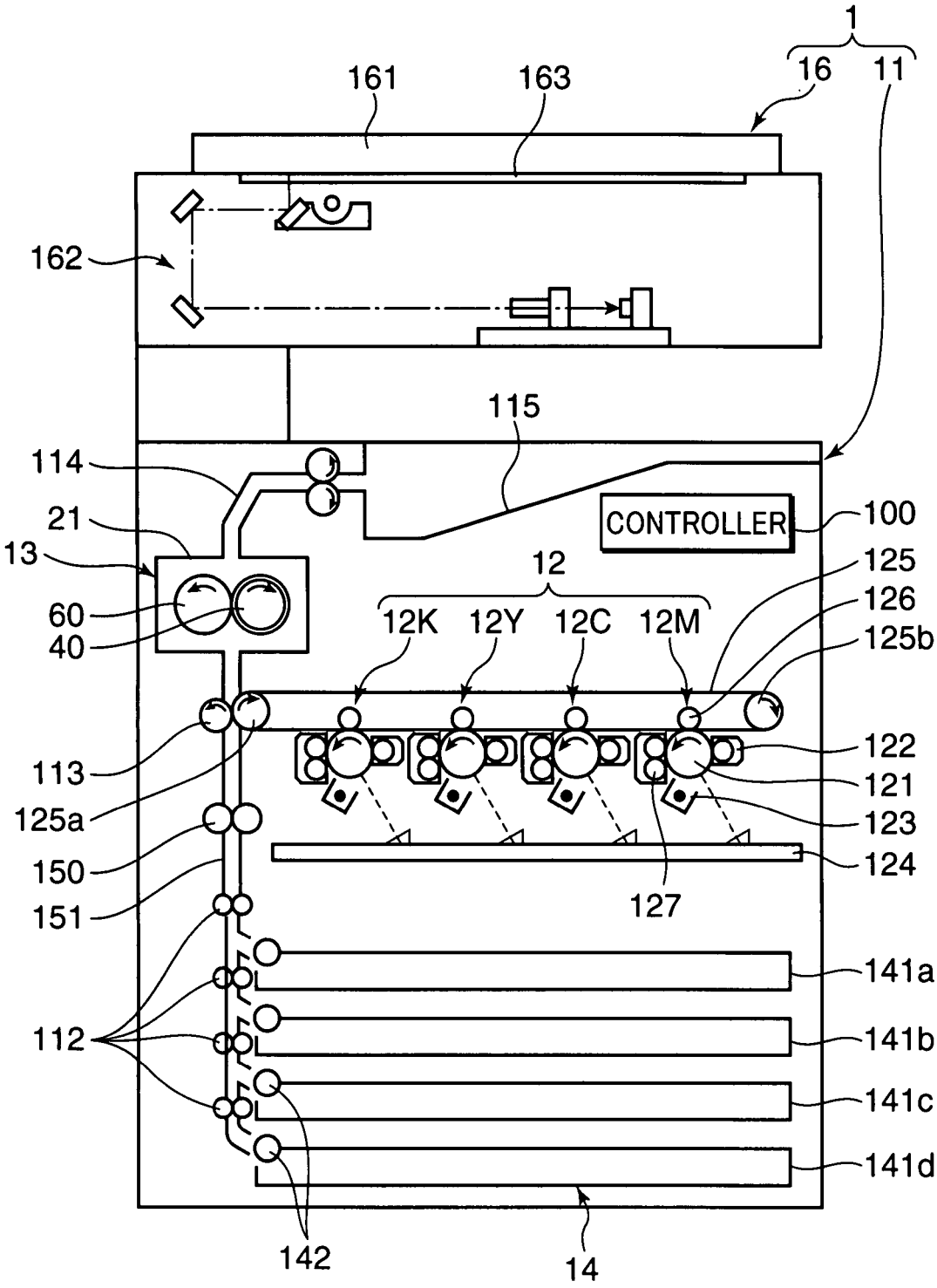
FIG. 1 is a front cross-sectional view showing a schematic configuration of an internal structure of an image forming apparatus according to an embodiment of the present invention.

Hereinafter, an image forming apparatus according to an embodiment of the present invention will be described with reference to the drawings. It should be noted that configurations identified with the same reference numerals in the drawings indicate that they have the same configurations, and descriptions of those will be omitted. FIG. 1 is a front cross-sectional view showing a schematic configuration of an internal structure of the image forming apparatus. As shown in FIG. 1, a complex machine 1, which is an example of the image forming apparatus according to the present invention, serves as a color copying machine, a printer, and a facsimile machine, and includes a box-shaped apparatus main body 11 of so-called in-body sheet discharging type, and an image reading section 16 provided in an upper portion of the apparatus main body 11 for reading out a document image.

The apparatus main body 11 includes an image forming section 12 for forming an image based on image information of a document read out by the image reading section 16, a fixing section 13 for applying a fixing processing to an image formed by the image forming section 12 and transferred onto a recording sheet P, and a sheet storage section 14 for storing recording sheets for transfer, and a controller 100 for totally controlling the complex machine 1.

The image reading section 16 includes a document pressing member 161 openably and closably provided on an upper side of the apparatus main body 11, and an optical image forming unit 162 provided in an upper portion in a housing of the apparatus main body 11 and facing the document pressing member 161 through a contact glass 163. The contact glass 163 is dimensioned to be a planar shape which is slightly smaller than the document pressing member 161 to read out a surface of a document placed on the contact glass 163. The document pressing member 161 pivots in forward and reverse directions about a predetermined axis provided on one side in an upper surface of the housing which is an element of the image reading section 16 so that it can be opened and closed.

At a predetermined part of the image reading section 16, there is provided an operation panel 118 which will be described hereinafter. The operation panel 118 is operable to input process conditions regarding a document reading, a copying processing, and the like. The operation panel 118 is provided with an unillustrated display panel and numerical keys, and further provided with a start button, a mode switching key, and the like.

The optical image forming unit 162 includes a light source, a plurality of mirrors, a lens image forming unit, a CCD (Charge Coupled Device), and the like which are simplistically depicted in FIG. 1. A light ray irradiated from the light source is reflected on a document surface, and the reflected light ray is inputted to the CCD as document information through the mirrors and the lens image forming unit. The document information as an analog quantity inputted to the CCD is converted to a digital signal and stored in a predetermined storage device.

The image forming section 12 is adapted to form a toner image on a recording sheet fed from the sheet storage section 14. In the present embodiment, the image forming section 12 includes a magenta image forming unit 12M (image forming device), a cyan image forming unit 12C (image forming device), a yellow image forming unit 12Y (image forming device), and a black image forming unit 12K (image forming device), and a secondary transferring device 113 (transferring device) which are provided successively from upstream (on the right hand in FIG. 1) to downstream.

Each of the image forming units 12M, 12C, 12Y, 12K is provided with a photoconductive drum 121 and a developing device 122. The photoconductive drum 121 rotates in a counter-clockwise direction in FIG. 1 and receives toner particles from the developing device 122. Toner particles are supplied to the developing device 122 from an unillustrated toner cartridge provided in the apparatus main body 11 on the front side (front side of a sheet of FIG. 1).

At a position directly under the photoconductive drum 121, there is provided a charging device 123. Further, at a position directly under the charging device 123, there is provided an exposing device 124. The exposing device 124 exposes the photoconductive drums 121 of the respective colors. A peripheral surface of the photoconductive drum 121 is uniformly charged with electricity by the charging device 123, and the exposing device 124 exposes a laser light ray corresponding to a respective color based on an image data inputted in the image reading section 16 to the charged peripheral surface of the photoconductive drum 121 to form an electrostatic latent image on the respective peripheral surface of each photoconductive drum 121. Then, the developing device 122 supplies toner particles to the electrostatic latent image to form a toner image on the peripheral surface of the photoconductive drum 121.

At a position above the photoconductive drums 121, there is provided an intermediate transferring belt 125 (image bearing member) so as to come in contact with the peripheral surfaces of the photoconductive drums 121. The intermediate transferring belt 125 extends between a driving roller 125*a* and a driven roller 125*b*. The intermediate transferring belt 125 is pressed onto the respective peripheral surfaces of the photoconductive drums 121 by transferring rollers 126 provided correspondingly to the photoconductive drums 121. The intermediate transferring belt 125 moves around the driving roller 125*a* and the driven roller 125*b* while being synchronized with the photoconductive drums 121.

When a color image formation is performed, the intermediate transferring belt 125 rotates to allow the photoconductive drum 121 of the magenta toner image forming unit 12M to transfer a magenta toner image to the surface of the intermediate transferring belt 125. Next, the photoconductive drum 121 of the cyan toner image forming unit 12C transfers in superimposed registration a cyan toner image to the position on the intermediate transferring belt 125 where the magenta toner image is formed. Next, the photoconductive drum 121 of the yellow toner image forming unit 12Y transfers in superimposed registration a yellow toner image to the same position on the intermediate transferring belt 125. Finally, the photoconductive drum 121 of the black toner image forming unit 12K transfers in superimposed registration a black toner image. Accordingly, a color toner image is formed on the surface of the intermediate transferring belt 125. The secondary transferring device 113 transfers the color toner image formed on the surface of the intermediate transferring belt 125 to a recording sheet P fed from the sheet storage section 14.

On the other hand, when a monochromatic image formation is performed, only a black toner image is transferred to the intermediate transferring belt 125 by the photoconductive drum 121 of the black color toner image forming unit 12K. Then, the secondary transferring device 113 transfers the black toner image formed on the surface of the intermediate transferring belt 125 to a recording sheet P fed from the sheet storage section 14.

At a position on the left side in FIG. 1 of each photoconductive drum 121, there is provided a cleaning device 127 for removing residual toner particles to clean the peripheral surface of the photoconductive drum 121. The part of the peripheral surface of the photoconductive drum 121 cleaned by the cleaning device 127 moves to the charging device 123 for the next charging processing.

The toner particles removed from the peripheral surface of the photoconductive drum 121 by the cleaning device 127 are collected and stored in an unillustrated toner collection bottle through a predetermined path.

In the periphery of the left end of the image forming section 12 in FIG. 1, there is formed a sheet conveyance passage 151 extending in a vertical direction. In the sheet conveyance passage 151, there is provided a pair of conveying rollers 112 at predetermined portions. A recording sheet fed from the sheet storage section 14 is conveyed by the driving of the pair of conveying rollers 112 toward the intermediate transferring belt 125 hung over the driving roller 125*a*.

In the sheet conveyance passage 151, there is provided the secondary transferring device 113 which comes in contact with the surface of the intermediate transferring belt 125 at a position of facing the driving roller 125*a*. The recording sheet P being conveyed in the sheet conveyance passage 151 is pressed and nipped by the intermediate transferring belt 125 and the secondary transferring device 113. Accordingly, a toner image formed on the intermediate transferring belt 125 is transferred to the recording sheet P. A peripheral speed of the driving roller 125*a* which is rotationally driven (running speed of the intermediate transferring belt 125) and a peripheral speed of the secondary transferring device 113 which is rotationally driven are set to be equal. Further, a recording sheet conveying speed of the pair of conveying rollers 112 and a registration roller (registration section) 150 and a recording sheet conveying speed of the driving roller 125*a* and the secondary transferring device 113 nipping the recording sheet P are set to be equal.

The fixing device 13 is adapted for applying a fixing processing to a toner image transferred to a recording sheet by the secondary transferring device 113. The fixing device 13 includes a heating roller 60 and a pressing roller 40. The heating roller 60 has a halogen lamp inside which is an electric heating body serving as a heating source. The pressing roller 40 is located so as to face the heating roller 60 and comes in contact with the heating roller 60 while applying a constant pressure. After the fixing processing is completed, the recording sheet P passes through a sheet discharging passage 114 extending from an upper portion of the fixing device 13 and is discharged to an in-body discharging tray 115.

The sheet storage section 14 includes a plurality of sheet cassettes 141*a*, 141*b*, 141*c*, 141*d* which are detachably mounted at positions under the exposing device 124 in the apparatus main body 11. Hereinafter, the sheet cassettes 141*a*, 141*b*, 141*c*, 141*d* are collectively referred to as a sheet cassette 141. When it is necessary to identify an individual sheet cassette, it will be identified with subscripts and named sheet cassette 141*a*, 141*b*, 141*c*, 141*d*.

The sheet cassettes 141*a*, 141*b*, 141*c*, 141*d* store stacks of recording sheets which are different in size from each other. In accordance with a control signal transmitted by the controller 100, any one of the sheet cassettes 141*a*, 141*b*, 141*c*, 141*d* is selected. Further, recording sheets P are taken out one after another by the driving of the pickup roller 142 from a stack of recording sheets stored in the selected sheet cassette 141. The recording sheet P taken out in such manner passes through the recording sheet conveyance passage 151 and proceeds to a nip portion defined between the secondary transferring device 113 and the intermediate transferring belt 125.

Figure 2:
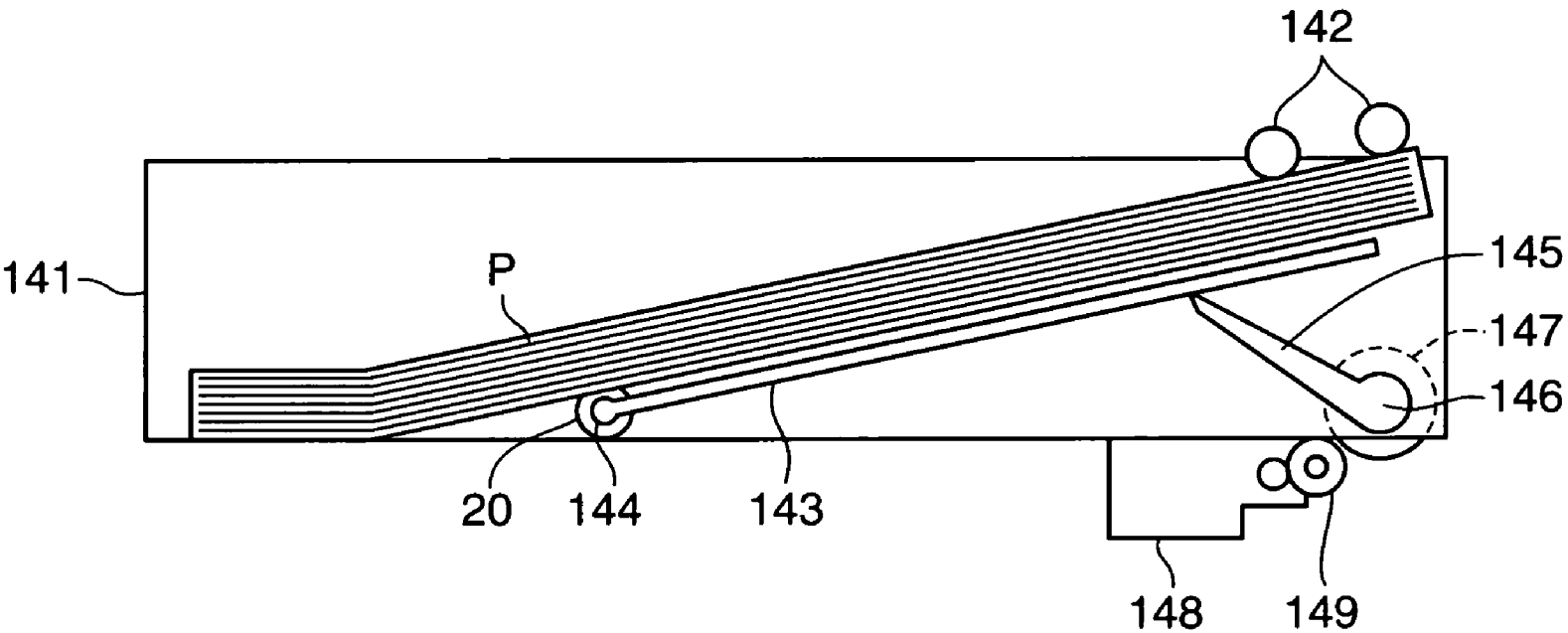
FIG. 2 is a cross-sectional view showing an example of a configuration of a sheet cassette shown in FIG. 1.

FIG. 2 is a cross-sectional view showing one example of a configuration of the sheet cassette 141. The sheet cassette 141 shown in FIG. 2 includes an inclining plate 143 which is pivotable about a support shaft 144, and a lifting arm 145 for changing the incline angle of the inclining plate 143. The lifting arm 145 raises and lowers its leading end in accordance with a rotation of a support shaft 146 driven by a lifting motor 148 (incline angle adjuster).

A motor-side gear 149 is fixed concentrically fixed to a driving shaft of the lifting motor 148. On the other hand, a lifting gear 147 which comes in mesh with the motor-side gear 149 through an unillustrated coupling and is integral with the support shaft 146 is attached to the support shaft 146 which is integral with the lifting arm 145. Then, the forward and reverse driving of the lifting motor 148 is transmitted to the inclining plate 143 through the motor-side gear 149, the lifting gear 147, the support shaft 146, and the lifting arm 145, and the inclining plate 143 pivots about the support shaft 144.

Further, a rotary encoder 20 (sheet amount detector) is fixed coaxially with the support shaft 144. Accordingly, an angle of rotation of the support shaft 144 i.e. an incline angle of the inclining plate 143 can be detected by the rotary encoder 20.

Further, there is provided a pickup roller 142 at a sheet-feeding position directly above a leading end portion of the inclining plate 143 in each of the sheet cassettes 141. Then, a recording sheet which is located at an uppermost part of a stack of recording sheets P placed on the inclining plate 143 is taken out toward the sheet conveyance passage 151 by rotation of the pickup roller 142.

The, lifting motor 148 allows the motor-side gear 149 to rotate in order to increase the incline angle of the inclining plate 143 as the number of recording sheets P placed on the inclining plate 143 decreases. Accordingly, a recording sheet P which is located at the uppermost position comes in contact with the pickup roller 142. Thus, since a recording sheet P which is at the upper most position among the recording sheets P placed on the inclining plate 143, the recording sheets P placed on the inclining plate 143 may be taken out by the pickup roller 142 regardless of decrease in the number of recording sheets P.

Therefore, the incline angle of the inclining plate 143 becomes small when the number of recording sheets P placed on the inclining plate 143 is large. On the other hand, the incline angle of the incline plate 143 becomes large, when the number of recording sheets P is small. Consequently, an incline angle of the inclining plate 143 detected by the rotary encoder 20 indicates the number of recording sheets placed on the inclining plate 143.

It should be noted that the sheet amount detector is not limited to the rotary encoder 20. For example, a detection switch may be used which comes into on-state when the incline angle of the inclining plate 143 becomes larger than an angle of the inclining plate 143 indicating that the number of recording sheets P placed on the inclining plate 143 is equal to the predetermined reference amount R.

Figure 3:
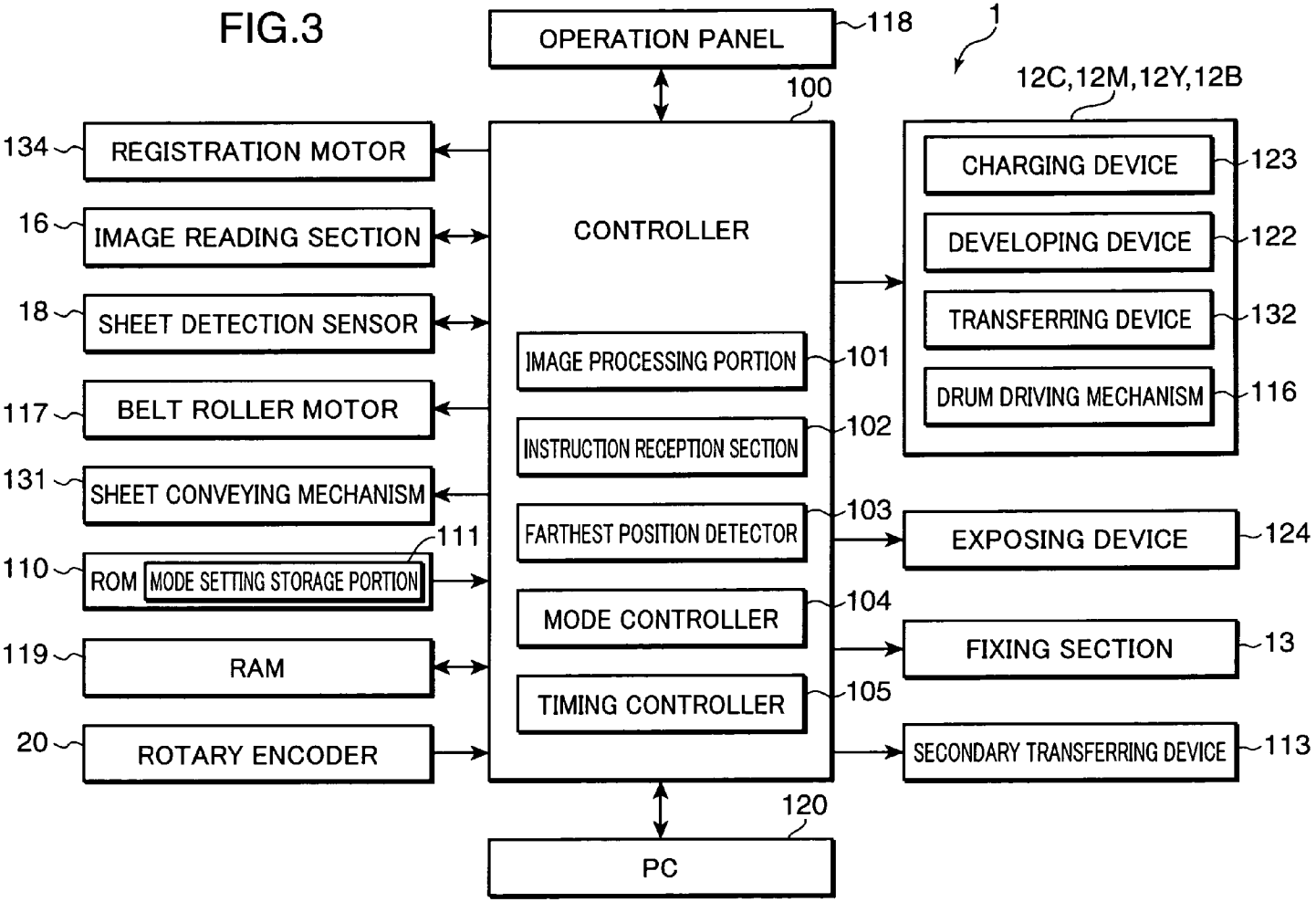
FIG. 3 is a block diagram showing an example of an electric schematic configuration of a complex machine shown in FIG. 1.

FIG. 3 is a block diagram showing an example of a schematic electric configuration of the complex machine 1. The controller 100 is composed of, for example, a CPU (Central Processing Unit), and is connected to a ROM (Read Only Memory) 110 which stores a program for operating the whole apparatus, and a RAM (Random Access Memory) 119 which temporarily stores image data and the like and serves as a working area. The controller 100 executes a control program stored in, for example, the ROM 110 to serve as an image processing portion 101, an instruction reception section 102, a farthest position detector 103, a mode controller 104, and a timing controller 105.

Further, the controller 100 is connected to the image reading section 16, a sheet detection sensor 18, a belt roller motor 117, a sheet conveying mechanism 131, a registration motor 134, a rotary encoder 20, image forming units 12C, 12M, 12Y, 12K for respective colors, an exposing device 124, a secondary transferring device 113, a fixing section 13, and an operation panel 118.

The image processing portion 101 performs controls regarding general image forming processing. The instruction reception section 102 receives operation instructions, such as an operation to perform image forming of a toner image to a recording sheet, which are inputted by an operator through operation of the operation panel 118. When the complex machine 1 serves as a printer which prints out print data transmitted from an external personal computer, the instruction reception section 102 receives the image forming instruction from the personal computer. Further, when the complex machine 1 serves as a facsimile apparatus, the instruction reception section 102 receives the image forming instruction from a facsimile apparatus which transmits facsimile data.

The farthest position detector 103 detects, among the image forming units which perform respective image forming operations in connection with the image forming instruction, an image forming unit which is located at a position having a longest moving distance of a toner image to the transferring device 113 on a moving course of the intermediate transferring belt 125 when the instruction reception section 102 receives the image forming instruction.

Specifically, at first, the image forming unit detected by the farthest position detector 103, in other words, the image forming unit which is located at a position having a longest moving distance of a toner image to the secondary transferring device 113 on the moving course of the intermediate transferring belt 125 differs in accordance with an image to be formed.

Specifically, in a case of forming a monochromatic image, the image forming units 12Y, 12C, 12M do not perform image forming. Therefore, the image forming unit 12K is located at a position having a longest moving distance of a toner image to the secondary transferring device 113. Further, when a color image is formed, the image forming unit 12M is generally located at a position having a longest moving distance of a toner image to the secondary transferring device 113. Further, for example, when a color image having a biased color, and a color image not including magenta but cyan is formed, the image forming unit 12C is located at a position having a longest moving distance of a toner image to the secondary transferring device 113. Further, when a color image not including magenta and cyan but yellow is formed, the image forming unit 12Y is at a position having a longest moving distance of a toner image to the secondary transferring device 113.

The farthest position detector 103 may detect the image forming unit located at a position having a longest moving distance of a toner image to the secondary transferring device 113 in a simple manner. For example, the farthest position detector 103 may detect the image forming unit 12K in a case of forming a monochromatic image, and may detect the image forming unit 12M in a case of forming a color image. Alternatively, the farthest position detector 103 may detect, among the magenta image forming unit 12M, the cyan image forming unit 12C, and the yellow image forming unit 12Y, the image forming unit used for an image forming operation as the image forming unit located at a position having a longest moving distance of a toner image when a single color image forming is performed (image forming with use of only one of the magenta image forming unit 12M, the cyan image forming unit 12C, and the yellow image forming unit 12Y).

As described above, the image forming unit located at a position having a longest moving distance of a toner image to the secondary transferring device 113 differs in accordance with an image to be formed. Therefore, the farthest position detector 103 detects among the image forming units 12C, 12M, 12Y, 12K which one is the image forming unit located at a position having a longest moving distance of a toner image to the secondary transferring device 113 in accordance with information presenting which one of a monochromatic image and color image the image forming instruction received by the instruction reception section 102 presents, and image data to be formed, such as image data obtained by the image reading section 16 from a document.

The mode controller 104 executes the image formation preceding mode operation of allowing the image forming units to start their respective image forming operations before the sheet conveying mechanism (sheet-feeding section) 131 conveys a recording sheet from the sheet cassette 141, when the instruction reception section 102 receives an image forming instruction, and the amount of recording sheets P detected by the rotary encoder 20 is greater than a predetermined reference amount R, and a distance between the image forming unit detected by the farthest position detector 103 and an image transfer position of the secondary transferring device 113 is longer than a distance between the sheet cassette 141 and the image transfer position of the secondary transferring device 113.

Further, the mode controller 104 executes the sheet conveyance preceding mode operation when the instruction reception section 102 receives the image forming instruction, and the amount of recording sheets P detected by the rotary encoder 20 is greater than the reference amount R, and the distance between the image forming unit detected by the farthest position detector 103 and the image transfer position of the secondary transferring device 113 is shorter than the distance between the sheet cassette 141 and the image transfer position of the secondary transferring device 113.

Furthermore, the mode controller 104 executes the sheet conveyance preceding mode operation of allowing the image forming units to start their respective image forming operations after the sheet conveying mechanism 131 conveys a recording sheet from sheet cassette 141 when the amount of recording sheets P detected by the rotary encoder 20 is less than the predetermined reference amount R.

The timing controller 105 controls a registration motor 134, which rotationally drives a registration roller 150 (FIG. 1), to adjust a time of allowing a recording sheet P conveyed by the sheet conveying mechanism 131 to arrive at an image transfer position of the secondary transferring device 113.

Each of the image forming units 12C, 12M, 12Y, 12K includes a charging device 123, a developing device 122, a transferring device 132 for applying a transfer bias voltage to the transferring roller 126 to allow the toner image formed on the photoconductive drum 121 to transfer to the intermediate transferring belt 125, and a drum driving mechanism 116 serving as a driving mechanism for the photoconductive drum 121. It should be noted that the image forming unit 12C, 12M, 12Y, 12K may commonly own a single drive power source for the respective drum driving mechanisms 116 of the photoconductive drums 121, or may own individual drive power sources respectively.

Further, FIG. 3 shows image forming units for yellow, magenta, cyan, black as a single unit. However, the image forming units are actually provided for respective colors and connected to and controlled by the controller 100.

Further, the image processing portion 101 controls the image reading section 16, the exposing device 124, the secondary transferring device 113, the fixing section 13, and a belt roller motor 117 serving as a drive power source for belt rollers 125*a*, 125*b* running the intermediate transferring belt 125. Further, the image processing portion 101 is connected to the operation panel 118 which allows an operator to input an operation of forming a monochromatic or color image, and connected to an external PC (personal computer) 120 through an interface 119. The complex machine 1 forms an image based on image data inputted from the PC 120, the image reading section 16, and the like.

The sheet conveying mechanism 131 conveys a recording sheet P from the sheet cassette 141 to the toner image transfer position, where the intermediate transferring belt 125 (driving roller 125*a*) and the secondary transferring device 113 are provided and a toner image is transferred to a recording sheet, in accordance with a control signal transmitted from the image processing portion 101. Then, the recording sheet P onto which the toner image is transferred at this position is discharged to the in-body sheet discharging tray 115.

Further, the image processing portion 101 controls the driving of the image forming units 12C, 12M, 12Y, 12K, the exposing device 124, the fixing section 13, and the secondary transferring device 113.

The ROM 110 includes a mode setting storing portion 111 storing mode selection information indicating which one of the image formation preceding mode and the sheet conveyance preceding mode should be selected which corresponds to the respective image forming units 12C, 12M, 12Y, 12K when the amount of recording sheets P in the sheet cassette 141 is greater than the reference amount R.

The image formation preceding mode allows the image forming units 12C, 12M, 12Y, 12K and the exposing device 124 to start their respective image forming operations before the sheet conveying mechanism (sheet-feeding section) 131 conveys a recording sheet from the sheet cassette 141. The sheet conveyance preceding mode allows the sheet conveying mechanism 131 to start conveying a recording sheet from the sheet cassette 141 before one or more image forming units, among the image forming units 12C, 12M, 12Y, 12K used for image forming operation, and the exposing device 124 perform their respective image forming operations.

The above-described modes include (1) an image formation preceding mode of allowing the image forming operation to start before the sheet conveying mechanism 131 conveys a recording sheet to a predetermined position on upstream of the toner image transfer position of the secondary transferring device 113 in a sheet conveyance direction on the sheet conveyance path 151. Further, the modes also include (2) a sheet conveyance preceding mode of allowing the image forming operation to start after the sheet conveying mechanism 131 conveys the recording sheet to the predetermined position on upstream of the toner image transfer position of the secondary transferring device in a sheet conveyance direction on the sheet conveyance path 151.

Next, the mode selection information stored in the mode setting storing portion 111 will be described. A moving distance A of a toner image between the image forming units 12C, 12M, 12Y, 12K and the secondary transferring device 113 (a distance between a nip portion defined by the photoconductive drum 121 and transferring roller 126 of the image forming unit, and the toner image transfer position of the secondary transferring device 113) differs respectively between the image forming units.

Further, a sheet conveying distance B between the sheet cassette 141 and the toner image transfer position of the secondary transferring device 113 (a distance between an end of a recording sheet in a sheet conveyance direction stored in the sheet cassette 141 and the toner image transfer position of the secondary transferring device 113) differs in accordance with which sheet cassette 141, among the sheet cassettes 141*a*, 141*b*, 141*c*, 141*d*, for taking out a recording sheet P stores the sheet, i.e. a size of a recording sheet P on which an image is formed.

Therefore, the mode setting storing portion 111 stores, in accordance with combinations of the image forming units 12C, 12M, 12Y, 12K and the sheet cassettes 141*a*, 141*b*, 141*c*, 141*d*, mode selection information of selecting the image formation preceding mode when the combination has a toner image moving distance A which is longer than a sheet conveying distance B, and mode selection information of selecting the sheet conveyance preceding mode when the combination has a toner image moving distance A which is shorter than a sheet conveying distance B.

The mode controller 104 selects any of the sheet cassette 141*a*, 141*b*, 141*c*, 141*d* as the sheet cassette 141 which takes out a recording sheet in accordance with a size of the recording sheet P on which an image is formed. When the instruction reception section 102 receives the image forming instruction and the amount of recording sheets of the selected sheet cassette 141 detected by the rotary encoder 20 is greater than the predetermined reference amount R, there is no likelihood that toner particles are disposed of due to loss of recording sheets P stored in the sheet cassette 141. Accordingly, corresponding to the combination of the selected sheet cassette 141 and the image forming unit detected by the farthest position detector 103, the mode controller 104 selects any one of the image formation preceding mode and the sheet conveyance preceding mode in accordance with the mode selection information stored in the mode setting storing portion 111.

Therefore, the mode setting storing portion 111 stores mode selection information determining a mode which should be selected based on a relation between the toner image moving distance A of each image forming unit and the sheet conveying distance B. On the other hand, as described above, a peripheral speed (running speed of the intermediate transferring belt 125) of the driving roller 125*a* and a peripheral speed of the roller of the secondary transferring device 113 are set to be equal, and a recording sheet conveyance speed of the pair of conveyance rollers 112 and registration roller 150 are set to be equal to the recording sheet conveyance speed of the driving roller 125*a* and secondary transferring device 113. Accordingly, if the image forming and sheet feeding are performed simultaneously, an assured control of determining whether the feeding of recording sheet P should precede or the image forming should precede in accordance with a determination regarding which one of the toner image formed on the intermediate transferring belt 125 and the recording sheet conveyed by the sheet conveying mechanism 131 arrives at the image transfer position of the secondary transferring device 113 earlier. Consequently, shortening of a time necessary for completing transfer of a toner image to the recording sheet P and reduction of the amount of disposed toner particles can be achieved simultaneously.

Further, when the instruction reception section 102 receives the image forming instruction and the amount of recording sheets P detected by the rotary encoder 20 of the selected sheet cassette 141 is less than the reference amount R, there is a likelihood in the image formation preceding mode that toner would be disposed of due to loss of recording sheets from the sheet cassette 141. Accordingly, the mode controller 104 selects the sheet conveyance preceding mode.

The reference amount R is set which is the number of recording sheets causing a likelihood that a prior toner image formed on the intermediate transferring belt 125 before the current toner image is formed is transferred to the recording sheet P and the recording sheet P is consumed before the current toner image formed on the intermediate transferring belt 125 by the image forming unit reaches the toner image transfer position of the secondary transferring device 113, and a recording sheet P onto which the currently formed toner image runs out, when the number of recording sheets P stored in the sheet cassette 141 is equal to the reference amount R and the image forming unit starts the image forming in the image formation preceding mode.

Figure 4:
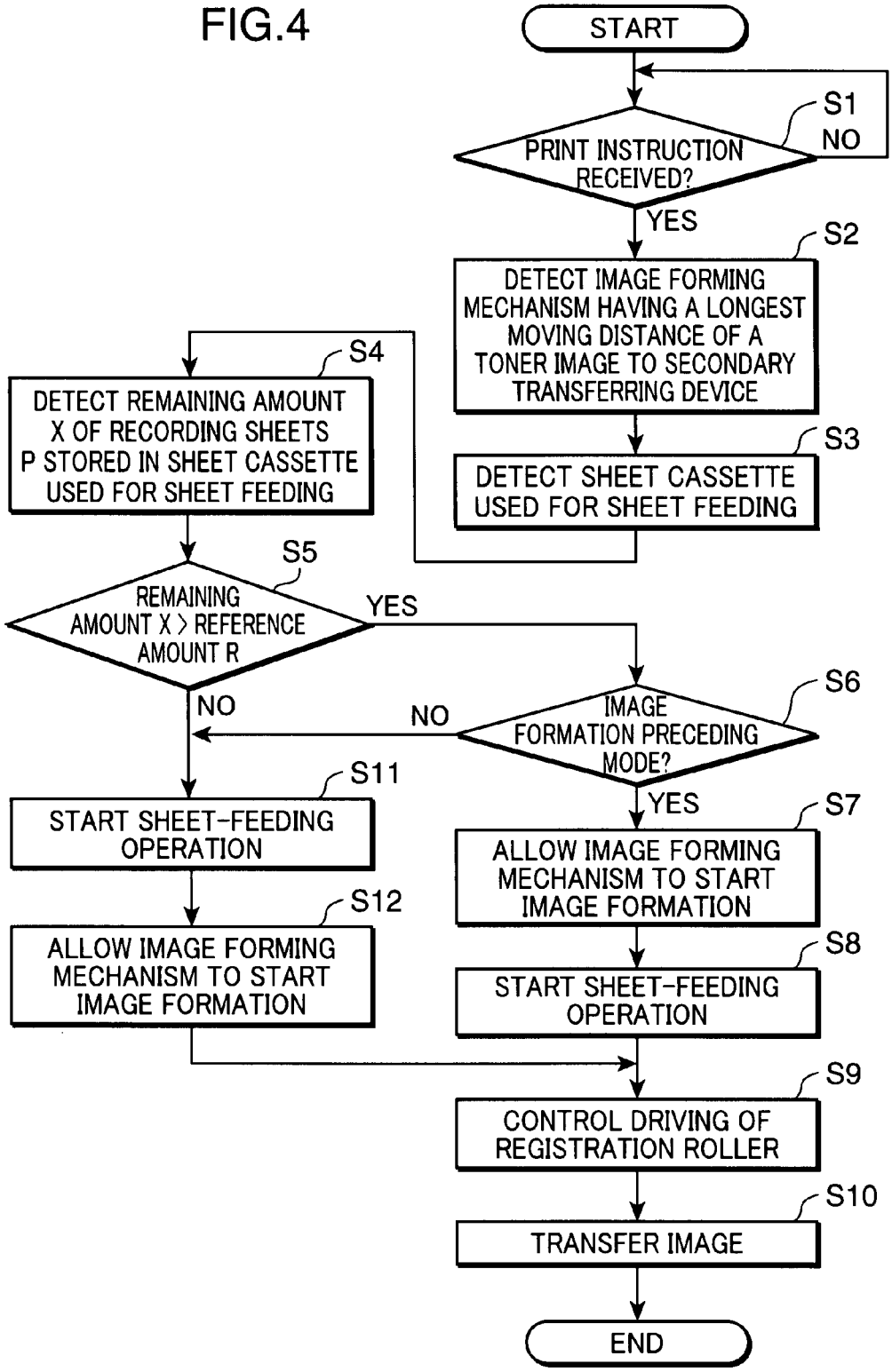
FIG. 4 is a flowchart showing an example of an operation of the complex machine shown in FIG. 1.

FIG. 4 is a flowchart showing an example of the image forming processing performed by the complex machine 1. In the complex machine 1, when the instruction reception section 102 receives a print instruction inputted by the operator through an operation of the operation panel 118 (YES in step S1), the farthest position detector 103 detects, among the image forming units which perform respective image operations in connection with the image forming instruction, the image forming device which is located at a position having a longest moving distance of a toner image to the secondary transferring device 113 on a moving course of the intermediate transferring belt 125 (step S2).

Next, the image processing portion 101 detects the sheet cassette 141 storing recording sheets P having a sheet size determined by an operation of the operation panel 118 as the sheet cassette 141 used for the current image forming operation (step S3).

Next, the mode controller 104 detects a remaining amount X of recording sheets P stored in the sheet cassette 141 in accordance with an output signal outputted from the rotary encoder 20 of the sheet cassette which is detected by the image processing portion 101 and used in the current image forming operation (step S4), and then the remaining amount X and the reference amount R are compared (step S5).

When the remaining amount X is equal to or less than the reference amount R (NO in step S5) and the image forming is executed in the image formation preceding mode, there is a likelihood that toner particles are disposed of due to lack of recording sheets P. Accordingly, the routine proceeds to step S11 to perform the image forming operation in the sheet conveyance preceding mode. On the other hand, when the remaining amount X is greater than the reference amount R (YES in step S5), the routine proceeds to step S6 to select any one of the sheet conveyance preceding mode and the image formation preceding mode.

In step S6, the mode controller 104 refers to the mode selection information stored in the mode setting storing portion 111 and selects a mode (the image formation preceding mode or the sheet conveyance preceding mode) which is set correspondingly to the combination of the image forming unit i.e. the magenta image forming unit 12M detected by the farthest position detector 103 and the sheet cassette detected in step S3.

When the mode controller 104 selects the image formation preceding mode (YES in step S6), the mode controller 104 allows the image forming operation performed by the respective image forming units and exposing devices 124 performing their respective image forming operations to be started before the sheet conveying mechanism 131 conveys a recording sheet from the sheet cassette 141 (step S7). Further, when the image forming operation performed by the image forming units and the exposing device 124 proceeds to a predetermined step (a timing of starting the sheet feeding at which the toner image formed on the intermediate transferring belt 125 and the recording sheet conveyed by the sheet conveying mechanism 131 comes to the toner image transfer position of the secondary transferring device 113 simultaneously so as to transfer the image), the mode controller 104 allows the sheet conveying mechanism 131 to start the sheet-feeding operation of feeding a recording sheet from sheet cassette 141 (step S8). Then, the routine proceeds to step S9.

On the other hand, when the mode controller 104 selects the sheet conveyance preceding mode, (NO in step S6), the mode controller 104 allows the sheet conveying mechanism 131 to perform the sheet feeding operation of feeding a recording sheet from the sheet cassette 141 before the respective image forming units and the exposing device 124 perform the image forming operation (step S11). Then, when the recording sheet is conveyed from the sheet cassette 141 to a predetermined position (a timing of starting the image forming operation performed by the respective image forming units and the exposing device 124 at which the toner image formed on the intermediate transferring belt 125 and the recording sheet conveyed by the sheet conveying mechanism 131 comes to the toner image transfer position of the secondary transferring device 113 simultaneously so as to transfer the image), the mode controller 104 allows the respective image forming units and the exposing device 124 to start the image forming operation (step S12). Then, the routine proceeds to step S9.

Next, in step S9, the sheet detection sensor 18 obtains a positional information of a recording sheet on upstream from the registration roller 150 in the sheet conveyance direction. Then, when the timing controller 105 detects in accordance with a detection signal of a recording sheet from the sheet detection sensor 18 that the recording sheet P conveyed by the sheet conveying mechanism 131 is conveyed to the secondary transferring device 113 at a timing earlier than the toner image conveyed by the intermediate transferring belt 125, the timing controller 105 suspends the registration roller 150 to stop conveyance of the recording sheet P at a position of the registration roller 150. Accordingly, it is adjusted to make an arrival timing of the recording sheet P and the toner image to the toner image transfer position of the secondary transferring device 113 simultaneously (step S9).

Then, after the timing controller 105 executes the timing adjustment above, the image processing portion 101 allows the registration motor 134 to drive rotationally, and the registration roller 150 conveys the recording sheet P to the secondary transferring device 113, and the secondary transferring device 113 transfers the toner image formed on the intermediate transferring belt 125 to the recording sheet P (step S10).

As described above, according to steps S1-S12, disposal of toner particles due to lack of recording sheets is suppressed by executing the sheet conveyance preceding mode operation when there is a likelihood that the amount of recording sheets P stored in the sheet cassette 141 is less than the reference amount R and disposal of toner particles occurs due to lack of recording sheets P in the image formation preceding mode. On the other hand, when the amount of recording sheets P stored in the sheet cassette 141 is greater than the reference amount R and there is no likelihood that disposal of toner due to lack of recording sheets P in the image formation preceding mode occurs, the printing time is further shortened by executing the image formation preceding mode if the recording sheet P can arrive at the secondary transferring device 113 earlier than the toner image in the image formation preceding mode in accordance with a longest moving distance of a toner image between the image forming unit and the secondary transferring device 113 and a conveyance distance of the recording sheet P from the sheet cassette 141 to the secondary transferring device 113. On the other hand, when there is a likelihood that the recording sheet P becomes late for the arrival timing of the toner image to the secondary transferring device 113 in the image formation preceding mode and disposal of toner particles occurs, the amount of disposed toner particles can be reduced by executing the sheet conveyance preceding mode.

In the embodiment of the present invention, the mode setting storing portion 111 stores mode selection information determining the mode should be selected based on a distance relationship between the toner image moving distance A of the respective image forming unit and the sheet conveying distance B, and the mode controller 104 selects any one of the image formation preceding mode and the sheet conveyance preceding mode in accordance with the mode selection information to shorten the printing time while reducing disposal of toner particles based on a distance relationship between the toner image moving distance A of the respective image forming unit and the sheet conveying distance B. However, the mode setting storing portion 111 may store the mode selection information as information which determines the mode which should be selected based on a toner image conveyance time At from the image forming unit to the secondary transferring device 113 and a sheet conveyance time Bt from the sheet cassette 141 to the secondary transferring device 113.

The mode controller 104 may select any one of the image formation preceding mode and the sheet conveyance preceding mode in accordance with the mode selection information based on the toner image conveyance time At and the recording sheet conveyance time Bt. In such case, when the remaining amount X of the recording sheets P detected by the rotary encoder 20 is greater than the reference amount R and the toner image conveyance time At is longer than the recording sheet conveyance time Bt, the mode controller 104 executes the image formation preceding mode operation. When the toner image conveyance time At is shorter than the recording sheet conveyance time Bt, the mode controller 104 may execute the sheet conveyance preceding mode operation.

Further, (1) image formation preceding mode includes a mode of allowing the image forming units 12C, 12M, 12Y, 12K and the exposing device 124 to perform the image forming operation before the sheet conveying mechanism 131 conveys the recording sheet from the sheet cassette 141, and (2) the sheet conveyance preceding mode includes a mode of allowing the sheet conveying mechanism 131 to start conveying the recording sheet from the sheet cassette 141 after the image forming operation is performed by the image forming units among the image forming units 12C, 12M, 12Y, 12K for use in the image forming operation and the exposing device 124. However, for example, a control of starting the image forming operation and the sheet-feeding operation simultaneously may be included in any one of (1) the image formation preceding mode and (2) the sheet conveyance preceding mode.

Further, the image forming apparatus is not limited to the complex machine but may be a copying machine, a printer, a facsimile machine, and the like.

An image forming apparatus according to one aspect of the present invention includes: a sheet-feeding section for taking out and feeding a recording sheet stored in a sheet cassette; an image forming section including: image forming devices provided for respective colors for forming a monochromatic or color toner image; an image bearing member for bearing a toner image formed by the image forming devices; and a transferring device for transferring the toner image formed on the image bearing member to a recording sheet conveyed by the sheet-feeding section; a sheet amount detector for detecting the amount of recording sheets stored in the sheet cassette; an instruction reception section for receiving an image forming instruction to form a toner image on a recording sheet; and a mode controller for executing an image formation preceding mode operation of allowing the image forming devices to start their respective image forming operations before the sheet feeding section conveys a recording sheet from the sheet cassette when the instruction reception section receives the image forming instruction and the amount of recording sheet detected by the sheet amount detector is greater than a predetermined reference amount, and executing a sheet conveyance preceding mode operation of allowing the image forming devices to start their respective image forming operations after the sheet-feeding section conveys the recording sheet from the sheet cassette when the instruction reception section receives the image forming instruction and the amount of recording sheets detected by the sheet amount detector is smaller than the reference amount.

According to this configuration, when the amount of recording sheets detected by the sheet amount detector is greater than the predetermined reference amount reference amount, the image formation preceding mode operation of allowing the image forming devices to start their respective image forming operation before the sheet-feeding section conveys the recording sheet from the sheet cassette is executed so that the printing time is shortened. In this case, even if the recording sheets stored in the sheet cassette are consumed, the recording sheets on which the toner image formed on the image bearing member is transferred by the image forming operation started in the image formation preceding mode would not run short. Thus, since the disposal of toner due to lack of recording sheets on which the toner image is transferred do not occur. Consequently, the amount of disposed toner particles can be reduced. On the other hand, when the amount of recording sheets detected by the sheet amount detector is smaller than the reference amount, in other words, when there is a likelihood that the recording sheets for transferring the toner image formed on the image bearing member by the image forming operation run out because the image forming operation is executed before the recording sheet is conveyed in the image formation preceding mode, and the recording sheets stored in the sheet cassette are consumed, the sheet conveyance preceding mode operation of allowing the respective image forming units to start their image forming operations after the sheet-feeding section conveys the recording sheets from the sheet cassette. Accordingly, the disposal of toner particles due to lack of recording sheets on which the toner image is transferred would not occur. Consequently, the amount of disposed toner particles can be reduced.

Further, it is preferable that the image forming apparatus further comprises a farthest position detector for detecting, among the image forming devices which perform respective image forming operations in connection with the image forming instruction, an image forming device which is located at a position having a longest moving distance of a toner image to the transferring device on a moving course of the image bearing member when the instruction reception section receives the image forming instruction. When the instruction reception section receives the image forming instruction and the amount of recording sheets detected by the sheet amount detector is greater than the reference amount, the mode controller executes the image formation preceding mode operation when a distance between the image forming device detected by the farthest position detector and an image transfer position of the transferring device is longer than a distance between the sheet cassette and the image transfer position of the transferring device, and executes the sheet conveyance preceding mode operation when the distance between the image forming device detected by the farthest position detector and the image transfer position of the transferring device is shorter than the distance between the sheet cassette and the image transfer position of the transferring device.

According to this configuration, when the amount of recording sheets detected by the sheet amount detector is greater than the reference amount, and it is assumed in accordance with a distance between the image forming device and the image transfer position of the transferring device that the toner image formed on the image bearing member by the respective image forming devices arrives at the toner image transfer position of the transferring device later than the recording sheet fed by the sheet-feeding section if the image forming and the sheet feeding are started at the same time, the mode controller executes the image formation preceding mode operation. Accordingly, the time from the starting of the image forming to the image bearing member and the sheet feeding and the completion of the toner image transfer to the recording sheet can be shortened. On the other hand, when it is assumed that the toner image formed on the image bearing member by the respective image forming devices arrives at the toner image transfer position of the transferring device earlier than the recording sheet fed by the sheet-feeding section if the image forming and the sheet feeding are performed at the same time, the mode controller executes the sheet conveyance preceding mode operation so that the delay in arrival of the recording sheet to the toner image transfer position can be prevented. Accordingly, the possibility of accurately transferring the toner image formed on the image bearing member to the recording sheet rises so that the reduction of the amount of disposed toner particles can be achieved.

Further, the image forming apparatus may further comprise further comprising a farthest position detector for detecting, among the image forming devices which perform respective image forming operations in connection with the image forming instruction, an image forming device which is located at a position having a longest moving distance of a toner image to the transferring device on a moving course of the image bearing member when the instruction reception section receives the image forming instruction. When the instruction reception section receives the image forming instruction and the amount of recording sheets detected by the sheet amount detector is greater than the reference amount, the mode controller executes the image formation preceding mode operation when a toner image conveyance time of conveying a toner image from the image forming device detected by the farthest position detector to a toner image transfer position of the transferring device on the moving course of the image bearing member is longer than a recording sheet conveyance time of the sheet-feeding section of conveying a recording sheet from the sheet cassette to the image transfer position of the transferring device, and executes the sheet conveyance preceding mode operation when the toner image conveyance time is shorter than the recording sheet conveyance time.

According to this configuration, when the amount of recording sheets detected by the sheet amount detector is greater than the reference amount, and a toner image conveyance time of conveying a toner image from the respective image forming device to a toner image transfer position of the transferring device is longer than a recording sheet conveyance time of conveying a recording sheet from the sheet cassette to the image transfer position of the transferring device, the mode controller executes the image formation preceding mode operation. Further, when the toner image conveyance time is shorter than the recording sheet conveyance time, the mode controller executes the sheet conveyance preceding mode. Thus, in accordance with which one of the toner image and the recording sheet arrives at the transfer position earlier when the image forming operation and the sheet-feeding operation are performed at the same time, it can be determined which one should be started earlier, the sheet feeding of the recording sheet or the image forming operation. Accordingly, both the shortening of time necessary for terminating the toner image transfer to the recording sheet and the reduction of the amount of disposed toner particles can be achieved.

Further, it is preferable that the image forming devices provided for respective colors include a black image forming device, and that the farthest position detector detects the black image forming device as the image forming device which is located at a position having a longest moving distance of a toner image to the transferring device when the instruction reception section receives an image forming instruction to form a monochromatic image.

According to this configuration, only the black image forming device is used among the image forming devices provided for respective colors when the monochromatic image is formed. Accordingly, there is no need to take in consideration the image forming devices for other colors. Therefore, the farthest position detector detects the black image forming device as the image forming device which is located at a position having a longest moving distance of a toner image to the transferring device when the instruction reception section receives an image forming instruction to form a monochromatic image. Accordingly, the image forming device which is located at a position having a longest moving distance of the toner image can be detected easily.

Further, it is preferable that the image forming apparatus further comprises: a registration section for allowing and suspending conveyance of a recording sheet fed by the sheet-feeding section to a sheet conveyance path which is upstream of the transferring device in a sheet conveyance direction; and a timing controller for controlling the driving of the registration section to adjust a time of allowing a recording sheet fed by the sheet-feeding section to arrive at a transfer position where the transferring device transfers a monochromatic or color image to the recording sheet.

According to this configuration, the timing controller controls the driving of the registration section to temporarily suspend conveyance of the recording sheet at upstream of the toner image transfer position of the transferring device in a sheet conveyance direction. Accordingly, a time of allowing the recording sheet and the toner image to arrive at the toner image transfer position of the transferring device can be adjusted accurately.

Further, it is preferable that the sheet cassette includes: an inclining plate which rises from a bottom of the sheet cassette toward a sheet-feeding position; and an incline angle adjuster for adjusting an incline angle of the inclining plate in such a manner that the uppermost part of recording sheets stacked on the inclining plate reaches the sheet-feeding position, and the sheet amount detector detects an amount of recording sheets in accordance with an incline angle of the inclining plate.

According to this configuration, the incline angle adjuster adjusts an incline angle of the inclining plate in such a manner that the upper most part of recording sheets stacked on the inclining plate reaches the sheet-feeding position. Accordingly, the sheet amount detector can detect the amount of recording sheets in accordance with an incline angle of the inclining plate.

Further, it is preferable that the image forming apparatus further comprises: a rotary encoder fixedly attached to a lower end of the inclining plate for detecting the incline angle of the inclining plate, the lower end being positioned near the bottom of the sheet cassette to thereby serve as a fulcrum axis, an axis of the rotary encoder being on the fulcrum axis, and the sheet amount detector detects the amount of recording sheets in accordance with an incline angle of the inclining plate detected by the rotary encoder.

According to this configuration, the amount of recording sheets stored in the sheet cassette can be detected by the rotary encoder.

Further, the image forming apparatus may be so configured to further comprise a detection switch which comes into an on-state when the incline angle of the inclining plate is larger than a reference angle indicating that the number of recording sheets is equal to the reference amount, and comes into an off-state when the incline angle is smaller than the reference angle, and the sheet amount detector detects the amount of recording sheets greater than the reference amount when the detection switch is in the on-state.

According to this configuration, it can be determined whether or not the amount of recording sheets stored in the sheet cassette is greater than the reference amount by using the detection switch which comes into an on-state when the incline angle of the inclining plate is larger than the reference angle indicating that the number of recording sheets is equal to the reference amount. Accordingly, the configuration of the sheet amount detector can be simplified.

This application is based on Japanese Patent application serial No. 2006-259481 filed in Japan Patent Office on Sep. 25, 2006, the contents of which are hereby incorporated by reference.

Although the present invention has been fully described by way of example with reference to the accompanying drawings, it is to be understood that various changes and modifications will be apparent to those skilled in the art. Therefore, unless otherwise such changes and modifications depart from the scope of the present invention hereinafter defined, they should be construed as being included therein.

What is claimed is:

1. An image forming apparatus comprising:

a sheet-feeding section for taking out and feeding a recording sheet stored in a sheet cassette;

an image forming section including:

image forming devices provided for respective colors for forming a monochromatic or color toner image;

an image bearing member for bearing a toner image formed by the image forming devices; and a transferring device for transferring the toner image formed on the image bearing member to the recording sheet conveyed by the sheet-feeding section;

a sheet amount detector for detecting the amount of recording sheets stored in the sheet cassette;

an instruction reception section for receiving an image forming instruction to form the toner image on the recording sheet;

a mode controller for executing an image formation preceding mode operation of allowing the image forming devices to start their respective image forming operations before the sheet feeding section conveys the recording sheet from the sheet cassette when the instruction reception section receives the image forming instruction and the amount of recording sheets detected by the sheet amount detector is greater than a predetermined reference amount, and executing a sheet conveyance preceding mode operation of allowing the image forming devices to start their respective image forming operations after the sheet-feeding section conveys the recording sheet from the sheet cassette when the instruction reception section receives the image forming instruction and the amount of recording sheets detected by the sheet amount detector is smaller than the reference amount; and a farthest position detector for detecting, among the image forming devices which perform respective image forming operations in connection with the image forming instruction, the image forming device which is located at a position having a longest moving distance of the toner image to the transferring device on a moving course of the image bearing member when the instruction reception section receives the image forming instruction, wherein when the instruction reception section receives the image forming instruction and the amount of recording sheets detected by the sheet amount detector is greater than the reference amount, the mode controller executes the image formation preceding mode operation when a distance between the image forming device detected by the farthest position detector and an image transfer position of the transferring device is longer than a distance between the sheet cassette and the image transfer position of the transferring device, and executes the sheet conveyance preceding mode operation when the distance between the image forming device detected by the farthest position detector and the image transfer position of the transferring device is shorter than the distance between the sheet cassette and the image transfer position of the transferring device.

2. The image forming apparatus according to claim 1, wherein:

the image forming devices provided for respective colors include a black image forming device, and the farthest position detector detects the black image forming device as the image forming device which is located at the position having the longest moving distance of the toner image to the transferring device when the instruction reception section receives an image forming instruction to form a monochromatic image.

3. The image forming apparatus according to claim 1, further comprising:

a registration section for allowing and suspending conveyance of the recording sheet fed by the sheet-feeding section to a sheet conveyance path which is upstream of the transferring device in a sheet conveyance direction; and a timing controller for controlling the driving of the registration section to adjust a time of allowing a recording sheet fed by the sheet-feeding section to arrive at a transfer position where the transferring device transfers a monochromatic or color image to the recording sheet.

4. The image forming apparatus according to claim 1, wherein:

the sheet cassette includes:

an inclining plate which rises from a bottom of the sheet cassette toward a sheet-feeding position; and an incline angle adjuster for adjusting an incline angle of the inclining plate in such a manner that the uppermost part of recording sheets stacked on the inclining plate reaches the sheet-feeding position, wherein the sheet amount detector detects an amount of recording sheets in accordance with an incline angle of the inclining plate.

5. The image forming apparatus according to claim 4, further comprising a rotary encoder fixedly attached to a lower end of the inclining plate for detecting the incline angle of the inclining plate, the lower end being positioned near the bottom of the sheet cassette to thereby serve as a fulcrum axis, an axis of the rotary encoder being on the fulcrum axis, wherein the sheet amount detector detects the amount of recording sheets in accordance with the incline angle of the inclining plate detected by the rotary encoder.

6. The image forming apparatus according to claim 4, further comprising a detection switch which comes into an on-state when the incline angle of the inclining plate is larger than a reference angle indicating that the number of recording sheets is equal to the reference amount, and comes into an off-state when the incline angle is smaller than the reference angle, wherein the sheet amount detector detects the amount of recording sheets greater than the reference amount when the detection switch is in the on-state.

7. An image forming apparatus comprising:

a sheet-feeding section for taking out and feeding a recording sheet stored in a sheet cassette;

an image forming section including:

image forming devices provided for respective colors for forming a monochromatic or color toner image;

an image bearing member for bearing a toner image formed by the image forming devices; and a transferring device for transferring the toner image formed on the image bearing member to the recording sheet conveyed by the sheet-feeding section;

a sheet amount detector for detecting the amount of recording sheets stored in the sheet cassette;

an instruction reception section for receiving an image forming instruction to form the toner image on the recording sheet;

a mode controller for executing an image formation preceding mode operation of allowing the image forming devices to start their respective image forming operations before the sheet feeding section conveys the recording sheet from the sheet cassette when the instruction reception section receives the image forming instruction and the amount of recording sheets detected by the sheet amount detector is greater than a predetermined reference amount, and executing a sheet conveyance preceding mode operation of allowing the image forming devices to start their respective image forming operations after the sheet-feeding section conveys the recording sheet from the sheet cassette when the instruction reception section receives the image forming instruction and the amount of recording sheets detected by the sheet amount detector is smaller than the reference amount; and a farthest position detector for detecting, among the image forming devices which perform respective image forming operations in connection with the image forming instruction, the image forming device which is located at a position having a longest moving distance of the toner image to the transferring device on a moving course of the image bearing member when the instruction reception section receives the image forming instruction, wherein when the instruction reception section receives the image forming instruction and the amount of recording sheets detected by the sheet amount detector is greater than the reference amount, the mode controller executes the image formation preceding mode operation when the toner image conveyance time of conveying a toner image from the image forming device detected by the farthest position detector to a toner image transfer position of the transferring device on the moving course of the image bearing member is longer than a recording sheet conveyance time of the sheet-feeding section of conveying a recording sheet from the sheet cassette to the image transfer position of the transferring device, and executes the sheet conveyance preceding mode operation when the toner image conveyance time is shorter than the recording sheet conveyance time.

8. The image forming apparatus according to claim 7, wherein:

the image forming devices provided for respective colors include a black image forming device, and the farthest position detector detects the black image forming device as the image forming device which is located at the position having the longest moving distance of the toner image to the transferring device when the instruction reception section receives an image forming instruction to form a monochromatic image.

9. The image forming apparatus according to claim 7, further comprising:

a registration section for allowing and suspending conveyance of the recording sheet fed by the sheet-feeding section to a sheet conveyance path which is upstream of the transferring device in a sheet conveyance direction; and a timing controller for controlling the driving of the registration section to adjust a time of allowing a recording sheet fed by the sheet-feeding section to arrive at a transfer position where the transferring device transfers a monochromatic or color image to the recording sheet.

10. The image forming apparatus according to claim 7, wherein:

the sheet cassette includes:

an inclining plate which rises from a bottom of the sheet cassette toward a sheet-feeding position; and an incline angle adjuster for adjusting an incline angle of the inclining plate in such a manner that the uppermost part of recording sheets stacked on the inclining plate reaches the sheet-feeding position, wherein the sheet amount detector detects an amount of recording sheets in accordance with an incline angle of the inclining plate.

11. The image forming apparatus according to claim 10, further comprising a rotary encoder fixedly attached to a lower end of the inclining plate for detecting the incline angle of the inclining plate, the lower end being positioned near the bottom of the sheet cassette to thereby serve as a fulcrum axis, an axis of the rotary encoder being on the fulcrum axis, wherein the sheet amount detector detects the amount of recording sheets in accordance with the incline angle of the inclining plate detected by the rotary encoder.

12. The image forming apparatus according to claim 10, further comprising a detection switch which comes into an on-state when the incline angle of the inclining plate is larger than a reference angle indicating that the number of recording sheets is equal to the reference amount, and comes into an off-state when the incline angle is smaller than the reference angle, wherein the sheet amount detector detects the amount of recording sheets greater than the reference amount when the detection switch is in the on-state.

* * * * *